US005857453A

United States Patent [19]

Caven et al.

[11] Patent Number: 5,857,453

[45] Date of Patent: Jan. 12, 1999

[54] PRECISION SLOT CUTTING MACHINE FOR CONCRETE AND ASPHALT

[75] Inventors: Joseph J. Caven, Kansas City, Mo.; Jeffrey K. Arnswald, Stillwell, Kans.

[73] Assignee: Magnum Diamond & Machinery, Inc., Grandview, Mo.

[21] Appl. No.: 883,392

[22] Filed: Jun. 26, 1997

[51] Int. Cl.[6] ..... B28D 1/04

[52] U.S. Cl. ..... 125/13.01; 125/13.03; 125/14; 299/39.1; 299/39.3

[58] Field of Search ..... 125/13.01, 13.03, 125/13.02, 14, 12; 299/39.1, 39.3; 451/352, 353, 358, 359

[56] References Cited

U.S. PATENT DOCUMENTS

| | | | |
|---|---|---|---|
| 4,375,212 | 3/1983 | Santschi | 125/14 |
| 4,748,966 | 6/1988 | Kennedy | 125/14 |
| 4,840,431 | 6/1989 | Jedick | 125/14 |
| 4,953,523 | 9/1990 | Swan | 125/14 |
| 5,676,126 | 10/1997 | Rupprecht et al. | 125/14 |
| 5,724,956 | 3/1998 | Ketterhagen | 125/13.01 |

OTHER PUBLICATIONS

Photographs illustrating Magnum Diamond & Machinery, Inc.'s transverse pavement groover, exact date unknown, but at least one year prior to the filing of the present application.

*Primary Examiner*—Eileen P. Morgan
*Attorney, Agent, or Firm*—Litman, McMahon & Brown, L.L.C.

[57] ABSTRACT

A precision slot cutting machine for concrete and asphalt pavement includes a self propelled unit with an operator's station and a blade platform is attached to the self propelled unit by a pair of pivot arms which allow the blade platform to freely pivot about an axis parallel to the path of travel of the self propelled unit. The blade platform is supported by a short based wheeled carriage with two independent wheel supporting bars, each of which is attached to the blade platform via a single pivot axis. The pivotal attachment between self propelled unit and blade platform and the independent pivoting action of the wheel supporting bars insure that variations which occur in the pavement surface both in directions parallel to and across the travel path of the machine are compensated for to allow precise cutting of slots of even depth into the pavement.

19 Claims, 4 Drawing Sheets

PRECISION SLOT CUTTING MACHINE FOR CONCRETE AND ASPHALT

FIELD OF THE INVENTION

The present invention relates to a machine which cuts precision slots in concrete and asphalt road pavement for the installation of recessed pavement marking tape. More particularly, the inventive machine includes a self propelled unit which carries an operator and power equipment. A blade platform is pivotably attached to the self propelled unit and is supported by wheels carried by pivoting wheel supporting bars to compensate for variations in pavement surface both along and across the path of travel of the machine.

BACKGROUND OF THE INVENTION

Traditionally, road pavement stripes were applied to road surfaces by spraying paint onto the road surface from specially equipped trucks. A number of problems are associated with painted pavement stripes. One problem is the tendency for paint to rapidly wear off due to the effects of vehicular traffic and weather conditions. Another problem is the poor reflectivity of painted stripes, particularly in fog or other low light conditions.

In response to these problems, specialized striping tapes have been developed to replace painted pavement stripes. These tapes, such as that sold under the Stamark™ name by the 3M Corporation, provide a dual benefit of greater reflectivity and greater resistance to elements. These marking tapes are typically on the order of about 60 mils in thickness, which thickness itself is both a benefit and a detriment. The benefit of the increased depth of the tape as compared to paint allows for much longer wear and durability. However, a problem occurs with the tape, especially when used on road surfaces in northern climates, in that snow plows tend to scrape the tape away along with the snow. Since the marking tape is considerably more expensive than painted stripes, the cost of replacing the tape after damage by snow plows has limited or prohibited its use in many regions.

Recently, experiments have been conducted with grooving the pavement before installation of the tape. Grooves of a depth somewhat less than the tape depth, e.g. on the order of 40 mils in depth, are cut into a concrete and asphalt pavement surface and the tape is then adhesively applied into the grooves. This has proven to be such an improved method of pavement marking tape installation that some states are mandating this type of application when marking tape is used. For example, the State of Kansas Department of Transportation (and the 3M Corporation) specify a groove depth for the application of pavement marking tape of 40 mil ±10 mil. This degree of precision has been impossible to achieve with existing concrete and asphalt slot cutting equipment. This is because existing equipment, such as that shown and described in U.S. Pat. No. 4,797,025 to Kennedy, is designed with blades which are directly attached to a propelling unit such that the unit is propelled forward while the cutting blades are lowered into the pavement to a predetermined depth. Due to the lengthy wheel base of the propelling unit and the rigid connection between the propelling unit and the blades, when the pavement surface has irregularities, such as high spots, the cutting blades will cut too deeply into the pavement, thus exceeding the specified slot depth. Conversely, when depressions occur in the pavement, the cutting blades will be raised to a point such that slots are too shallow. In extreme dips in the pavement surface, the cutting blades can actually skip out of the pavement, leaving gaps in the slots.

It is clear then, that a need exists for a concrete and asphalt slot cutting machine which can cut slots of a precise depth into road pavement regardless of irregularities in the pavement surface. Such a machine should be reliable and durable yet simple to operate.

SUMMARY OF THE INVENTION

The present invention is directed to a precision slot cutting machine for concrete and asphalt pavement and includes a self propelled unit upon which are mounted an engine, a source of cooling water and associated pump, a hydraulic pump and an operator station and controls. A blade platform is attached to the self propelled unit by a pair of pivot arms which allow the blade platform to freely pivot about an axis parallel to the path of travel of the self propelled unit. This allows the blade platform to freely tilt from side to side to compensate for variations in pavement surface which extend across the path of travel of the machine. The blade platform is supported by wheels carried by pivoting wheel supporting bars attached to the blade platform via independent pivot axes which extend orthogonally to the travel path of the self propelled unit. This independent pivoting action of the blade platform wheel supporting bars insures that variations which occur in the pavement surface in a direction parallel to the travel path of the machine are compensated for by the pivoting action and the relatively short wheel base of the blade platform. Depth control of the blades is provided via a threaded adjustment which raises and lowers respective wheel supporting bar pivot frames relative to the blade platform so that the wheels also act as depth gauging wheels. A hydraulic piston & cylinder unit is attached between a rigid frame extension member on the self propelled unit and a cross member extending between the pivot arms to raise and lower the blade platform and to isolate the blade platform from the weight of the self propelled unit.

OBJECTS AND ADVANTAGES OF THE INVENTION

The principal objects of the present invention include: providing a precision slot cutting machine for concrete and asphalt pavement; providing such a machine which includes a blade platform mounted on a self propelled unit; providing such a machine in which the blade platform is pivotably attached to the self propelled unit in a fashion which allows the blade platform to tilt from side to side; providing such a machine in which the blade platform is supported by a wheels attached to wheel supporting bars which are pivotably attached to the blade platform via independent pivot axes; providing such a machine in which blade depth is adjusted by adjusting the height of the wheel supporting bars and respective bar pivot frames relative to the blade platform; providing such a machine in which a hydraulic piston & cylinder unit is attached between the pivot arms and the frame of the self propelled unit to allow the blade platform to be selectively lifted and to isolate the blade platform from the weight of the self propelled unit; providing such a machine which cuts grooves of a substantially uniform depth regardless of variations in the surface of road pavement; and providing such a machine which is simple to use, is strong and durable and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein, however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
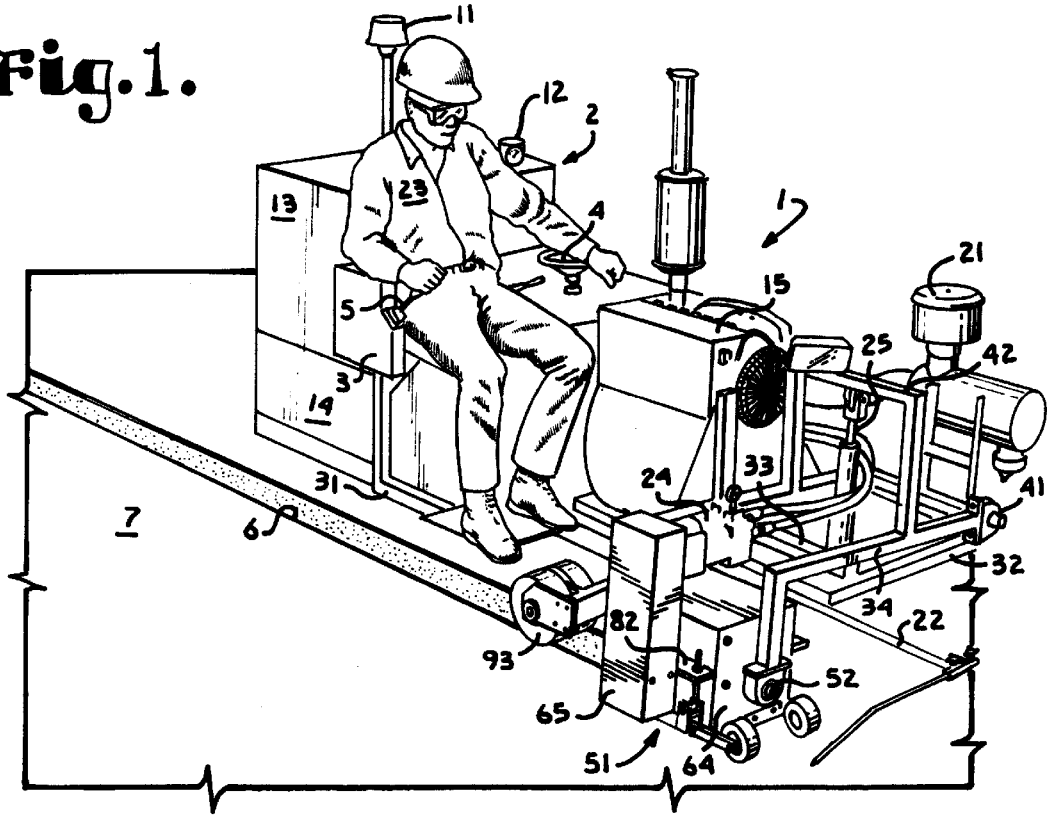
FIG. 1 is a perspective view of a precision slot cutting machine for concrete and asphalt pavement, showing the machine cutting a slot of uniform depth in the pavement surface.
Figure 2:
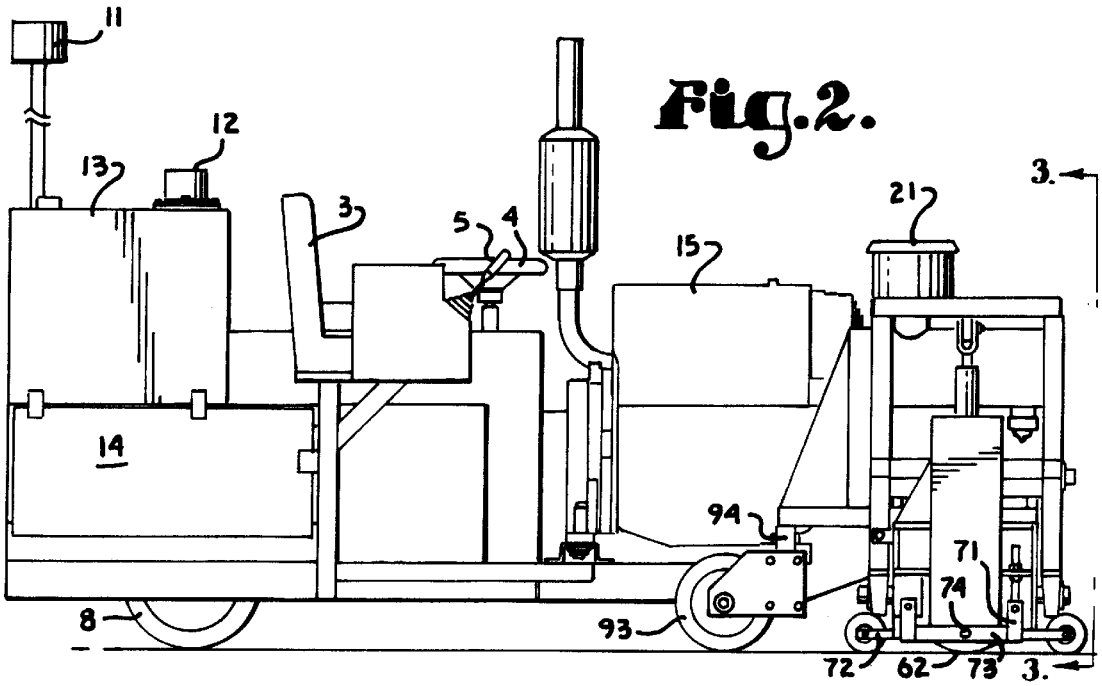
FIG. 2 is an enlarged, side elevational view of the slot cutting machine of FIG. 1.

Referring to the drawings, a precision slot cutting machine for concrete and asphalt pavement is shown and generally indicated at 1. The machine 1 includes a self propelled unit 2 including an operator's station with a seat 3, a steering wheel 4 and a hydraulic lift control 5. The machine 1 is shown in FIG. 1 cutting a precision slot 6 in a pavement surface 7 for installation of a strip of pavement marking tape (not shown).

The self propelled unit 2 is supported and driven by wheels 8 and includes many features found on typical concrete saws, including a warning light 11, a hydraulic oil filter and restriction gauge 12, a fuel tank 13, a sheet metal cover 14, and a diesel engine 15 with an air intake 21. A sight gauge 22 is mounted on the front of the unit 2 to provide an alignment aid for an operator 23. In addition to propelling the machine 1, the engine 15 drives a hydraulic pump (not shown) which provides pressurized hydraulic fluid to a hydraulic motor 24 and a lifting hydraulic piston & cylinder unit 25.

The self propelled unit 2 includes a tubular steel frame 31 including a generally rectangular forward frame extension 32 with a cross bar 33. A pair of L shaped pivot arms 34 are attached to the left side of the forward frame extension 32 via respective pivot mounts 41. The L shaped pivot arms 34 are interconnected horizontally via a cross bar 42 attached at either end thereof to respective vertical frame members 43, each of which is, in turn, attached to a respective one of the pivot arms 34. The lifting hydraulic piston and cylinder unit 25 is attached at an upper end to the cross bar 42 and at a lower end to the forward frame extension cross bar 33. The lifting piston & cylinder unit 25 thus allows the operator 23 to selectively lift the pivot arms 34 relative to the forward frame extension 32.

Figure 3:
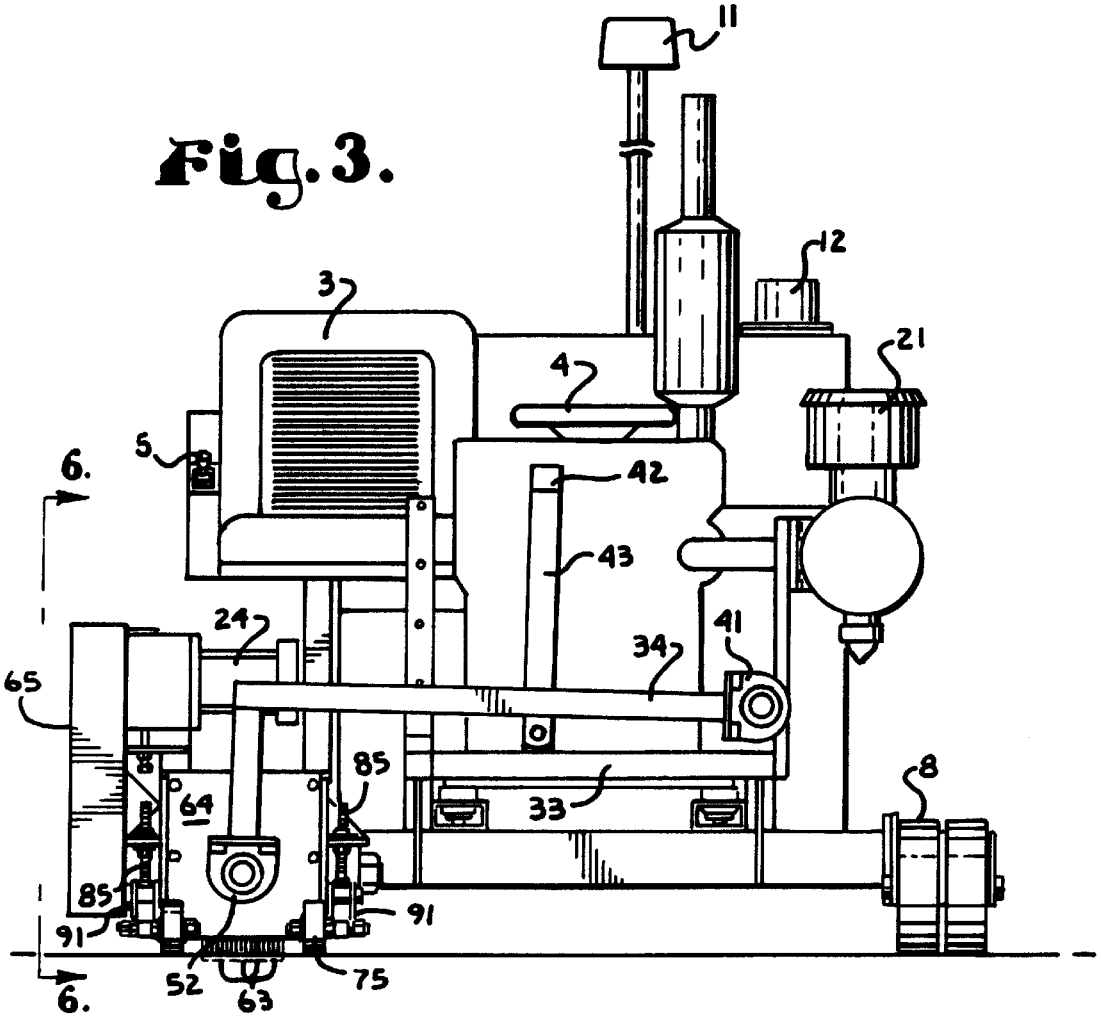
FIG. 3 is an enlarged, front elevational view of the slot cutting machine, taken along the line 3—3 of FIG. 2.
Figure 4:
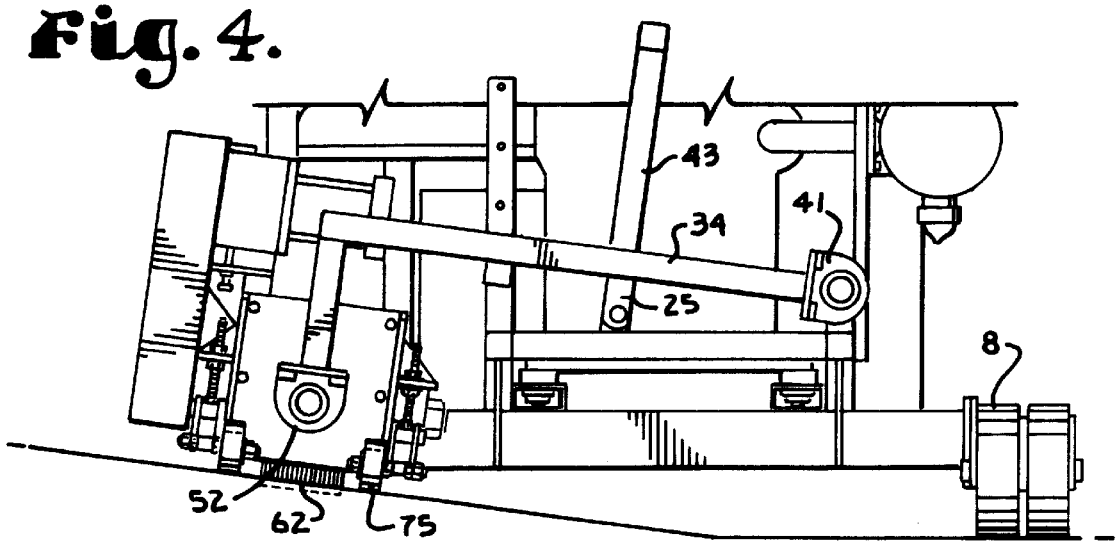
FIG. 4 is a fragmentary front elevational view of the slot cutting machine with a blade platform tilted to one side relative to a self propelled unit to compensate for side to side variations in the pavement surface.
Figure 5:
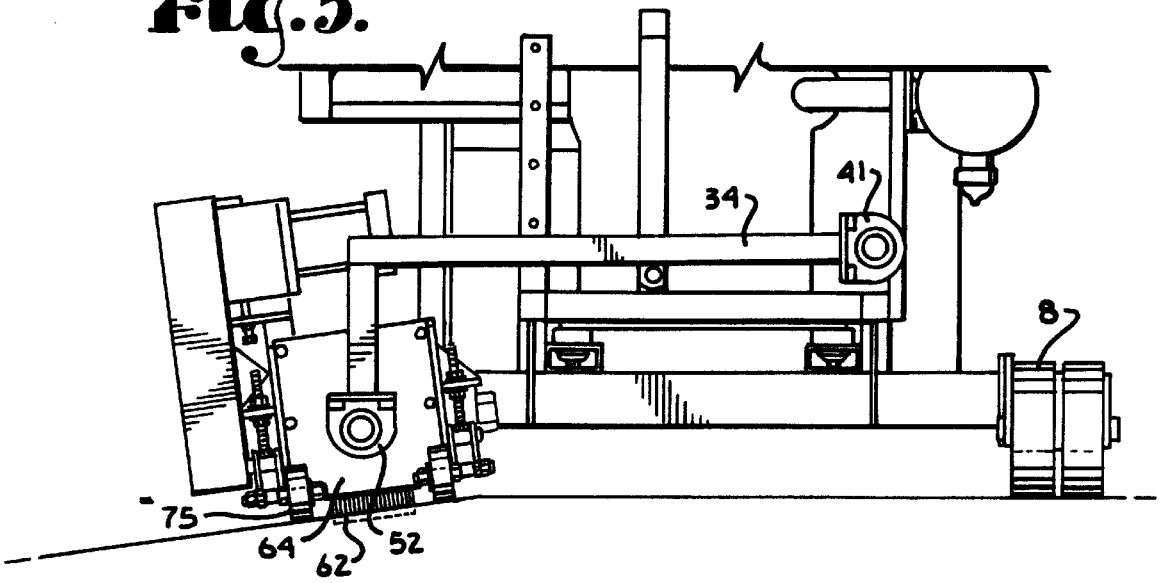
FIG. 5 is an enlarged, fragmentary front elevational view of the slot cutting machine with the blade platform tilted to a side opposite from that in FIG. 4, to compensate for opposite side to side variations in the pavement surface.

The L shaped pivot arms 34 are pivotably connected to a blade platform 51 via respective forward and rear pivots 52. The blade platform 51 supports the hydraulic motor 24 which drives an upper sheave 54, shown in phantom in FIG. 7. A belt 55 connects the upper sheave 54 to a lower sheave 60 which, in turn, drives a blade drive shaft 61 supporting a cutting blade 62. The cutting blade 62 is actually comprised of a number of individual diamond coated blades 63 connected together to form a cutting head of the desired slot width, as illustrated in FIGS. 3–5. The hydraulic motor 24, the sheaves 54 and 60, the belt 55 and the blade drive shaft 61 of the blade 62 along with a rectangular belt cover 65 are all attached to a common blade receiving housing 64.

A pair of U shaped channel pivot frames 71 support respective elongate bars 72 which are received within a bottom channel member 73 of the U shaped channel pivot frame 71 and attached thereto at a respective centered pivot axis 74. Each elongate bar 72 has a wheel 75 mounted at each end thereof and each elongate bar 72, with attached wheels 75, is thus independently pivotable with respect to the respective U shaped channel pivot frame 71 via the respective pivot axis 74. Each pivot axis 74 of the elongate bars 72 is positioned immediately below the center of the blade drive shaft 61.

The blade receiving housing 64 is generally rectangular and open on the bottom such that the blade 62 extends downward therefrom. The housing 64 is attached between both L shaped pivot arms 34 via the respective forward and rear pivots 52 and includes a pair of plates 82 extending generally horizontally outward therefrom. A respective vertical pivot plate 83 is attached to and extends downward from the front of each plate 82 and a respective front vertical channel member 84 of each U shaped channel pivot frame 71 is pivotably attached to each plate 83. Respective threaded adjustment bolts 85 are pivotably attached to each of a pair of rear vertical channel members 91 of the U shaped channel pivot frames 71 and extend upward therefrom through a vertical bore positioned near the rear of each horizontal plate 82. Each threaded bolt 85 includes a pair of nuts 92 which allow the wheels 75, via the elongate bars 72 and the U shaped channel pivot frames 71 to be adjustable vertically with respect to the blade receiving housing 64, including the hydraulic motor 24, the sheaves 54 and 60, the belt 55 and the blade drive shaft 61 and attached blade 62. This allows for an adjustment of the cutting depth of the blade 62. A pair of outrigger support wheels 93 are attached to the forward frame extension 32 via an upright post 94 to supply additional support for the self propelled unit 2 to counteract the weight of the blade platform 51.

Referring to FIGS. 4–7, the advantages of the inventive machine 1 are illustrated. It should be noted that irregularities of concrete or asphalt pavement surfaces have been shown greatly exaggerated in FIGS. 4–7 for purposes of ease of illustration of the invention.

FIG. 4 illustrates an abrupt incline of the pavement surface 7 from left to right across the path of travel of the machine 1 while FIG. 5 illustrates an opposite abrupt incline in the pavement surface 7 from right to left. These figures illustrate the flexibility achieved by the connection of the blade platform 51 to the self propelled unit 2 via the L shaped pivot arms 34 and the pivot attachments 41 and 52. As the pavement surface varies across the path of travel of the machine 1, the blade platform 51 pivots to allow the machine 1 to continue the cutting of the precision slot 6 by following the pavement contour.

Figure 6:
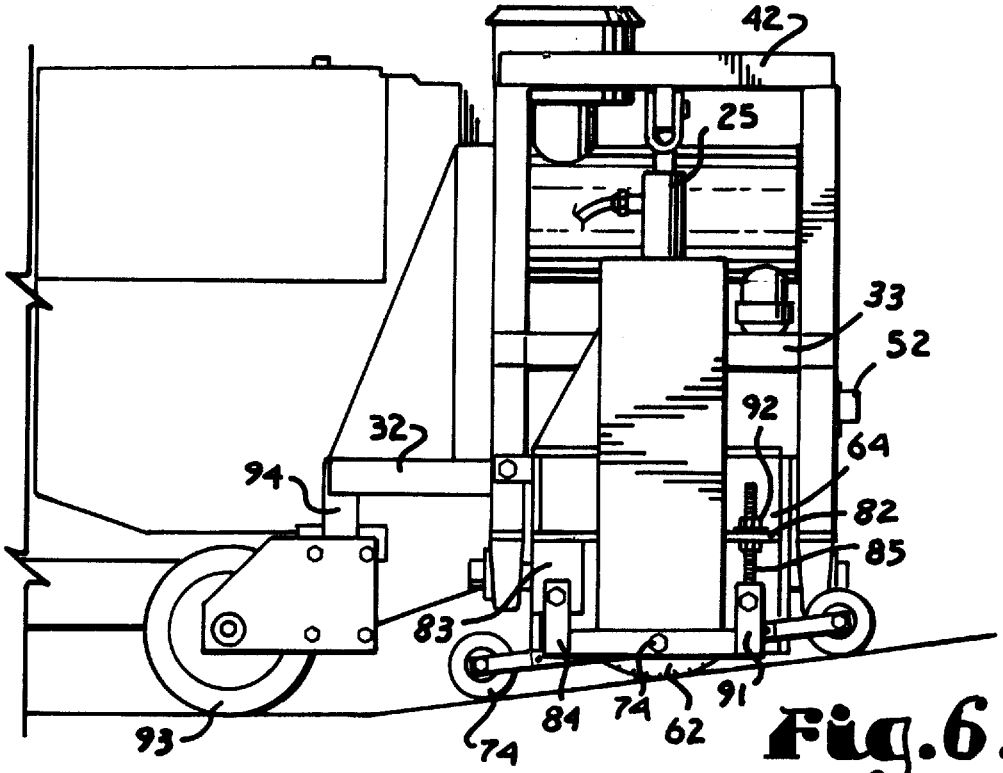
FIG. 6 is an enlarged, fragmentary side elevational view of the slot cutting machine, taken along line 6—6 of FIG. 3, with the wheeled carriage of the blade platform tilted to compensate for an incline in the pavement along the path of travel of the machine.
Figure 7:
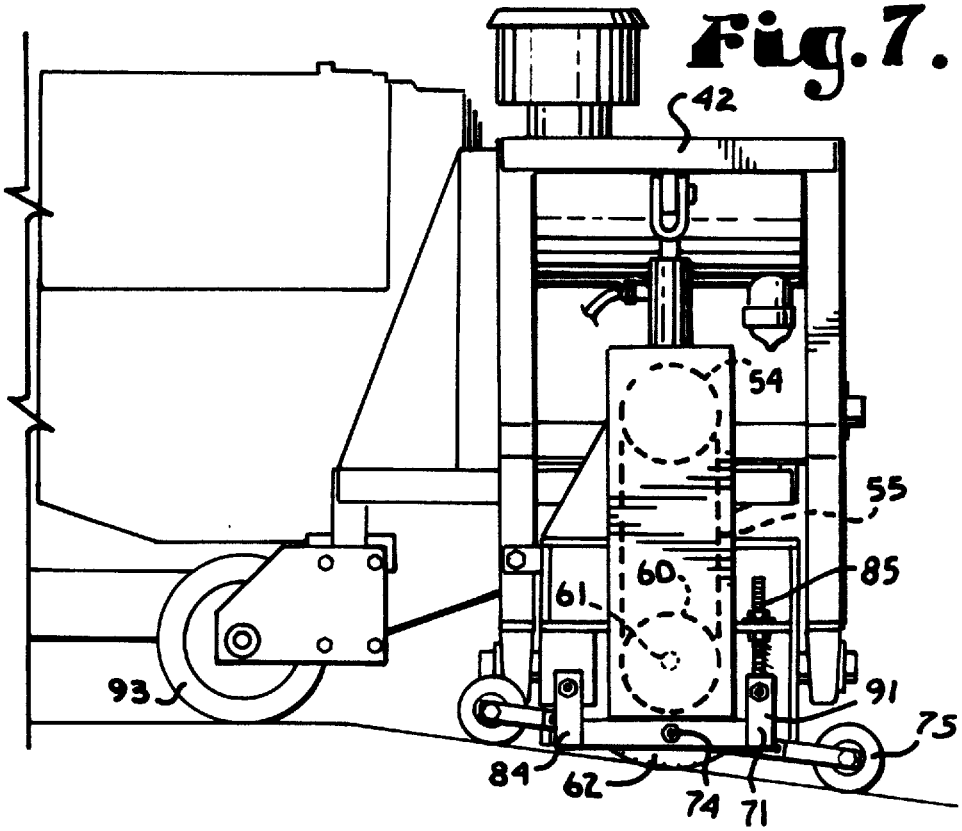
FIG. 7 is an enlarged, fragmentary side elevational view of the slot cutting machine, with the wheeled carriage of the blade platform tilted to compensate for a downward slant in the pavement along the path of travel of the machine.

Similarly, FIGS. 6 illustrates an abrupt incline of the pavement surface 7 upward along the path of travel of the machine 1 while FIG. 7 illustrates an opposite abrupt down slope in the pavement surface 7, again along the path of travel of the machine 1. These figures illustrate the flexibility achieved by the centered pivot axis of the wheel supporting elongate bars 72 in the U shaped channel pivot frames 71 at respective centered pivot axis 74.

FIG. 6 illustrates the front wheels 75 pivoting upward while the rear wheels 75 pivot downward to compensate for the upward slope. Since the pivot axis 74 are positioned immediately below the blade drive shaft 61 of the blade 62, the cutting depth of the blade 62 remains constant, permitting the precision cutting of the slot 6 to continue.

Conversely, FIG. 6 illustrates the front wheels 75 pivoting downward while the rear wheels 75 pivot upward to compensate for the downward slope. Again, this pivoting action of the elongate bars 72 allows the cutting depth of the blade 62 to remain constant, permitting the precision cutting of the slot 6. to continue.

Although not shown in FIGS. 4–7, a compound slope, i.e. a combination of pavement irregularities across and along the path of travel of the machine 1 is compensated for by a combination of left-right tilt of the housing 64 and pivoting action of the elongate bars 72. Furthermore, the separate, independent pivotability of the front and rear of the housing 64 and the independent pivotability of the left and right elongate bars 72 allow the blade platform 51 to compensate for pavement irregularities occurring beneath the blade platform 51.

The position of the blade platform 51 relative to the self propelled unit 2 is exemplary only and other arrangements could be equally effective. For example, the platform 51 could be positioned behind and to the side of the self propelled unit 2. Furthermore, the pivoting attachment between the self propelled unit 2 and the platform 51 could extend along the path of movement of the machine 1 with the pivoting wheel supporting elongate bars 72 being mounted to pivot across the path of travel. While the machine 1 has been illustrated as being manually controlled, where intermittent slots are need for the placement of pavement marking tape, an electronic control could be provided which automatically, intermittently raises and lowers the blade platform 51 at times based upon the speed of movement of the machine 1. The blade 62 has been illustrated as driven by a hydraulic motor 24, but it could also be driven by a mechanical linkage to a PTO or a dedicated electric motor or gasoline engine. It is thus to be understood that while certain forms of the present invention have been illustrated and described herein, it is not to be limited to the specific forms or arrangement of parts described and shown.

What is claimed and desired to be secured by Letters Patent is as follows:

1. A precision concrete and asphalt slot cutting machine, comprising:

a) a self propelled unit;

b) a blade platform;

c) a slot cutting blade positioned within the blade platform; and d) at least one pivot arm with a first end pivotably attached to the self propelled unit and a second end pivotably attached to the blade platform, said pivot arm allowing said blade platform to tilt from side to side in a direction transverse to the path of travel of said self propelled unit.

2. A concrete and asphalt slot cutting machine as in claim 1, wherein said blade platform has first, second, third and fourth sides with said first and second sides being opposite each other and said third and fourth sides being opposite each other and wherein there are two of said pivot arms, both of which have a first end pivotably attached to said self propelled unit with a first of said pivot arms having a second end pivotably attached to said first side of said blade platform and a second of said pivot arms being spaced from said first pivot arm and having a second end pivotably attached to said second side of said blade platform.

3. A concrete and asphalt slot cutting machine as in claim 2, wherein each of said pivot arms is L shaped with a long leg of each L shaped arm being pivotably attached to said self propelled unit and a short leg of each L shaped arm being pivotably attached to said blade platform.

4. A concrete and asphalt slot cutting machine as in claim 2, and further comprising:

a) a frame extension extending outward from said self propelled unit;

b) a cross bar interconnecting said pivot arms; and c) a hydraulic piston & cylinder unit with a first end attached to said frame extension and a second end attached to said cross bar.

5. A concrete and asphalt slot cutting machine as in claim 1, and further comprising:

a) a first wheel supporting bar with a first wheel supported near a first end thereof and a second wheel supported near a second end thereof;

b) a second wheel supporting bar with a third wheel supported near a first end thereof and a fourth wheel supported near a second end thereof;

c) a first pivot frame attached to said third side of said blade platform and pivotably supporting said first wheel supporting bar about a first pivot axis; and d) a second pivot frame attached to said fourth side of said blade platform and pivotably supporting said second wheel supporting bar about a second pivot axis.

6. A concrete and asphalt slot cutting machine as in claim 5, and further comprising:

a) a blade drive shaft attached to said slot cutting blade;

b) drive means for driving said blade drive shaft in a rotary motion; and wherein c) said first pivot axis of said first wheel supporting bar and said second pivot axis of said second wheel supporting bar are aligned vertically with said blade drive shaft.

7. A concrete and asphalt slot cutting machine as in claim 5, wherein said first and second pivot frames are vertically adjustable with respect to said third and fourth sides of said blade platform, respectively, such that the cutting depth of said slot cutting blade is adjustable.

8. A precision concrete and asphalt slot cutting machine, comprising:

a) a self propelled unit;

b) a blade platform attached to said self propelled unit, said blade platform including first, second, third and fourth sides with said first and second sides being opposite each other and said third and fourth sides being opposite each other;

c) a slot cutting blade positioned within the blade platform;

d) a first wheel supporting bar with a first wheel supported near a first end thereof and a second wheel supported near a second end thereof;

e) a second wheel supporting bar with a third wheel supported near a first end thereof and a fourth wheel supported near a second end thereof;

f) a first pivot frame attached to said third side of said blade platform and pivotably supporting said first wheel supporting bar about a first pivot axis; and g) a second pivot frame attached to said fourth side of said blade platform and pivotably supporting said second wheel supporting bar about a second pivot axis, said first and second pivot axes being in alignment with each other.

9. A concrete and asphalt slot cutting machine as in claim 8, and further comprising:

a) a blade drive shaft attached to said slot cutting blade;

b) drive means for driving said drive shaft in a rotary motion; and wherein c) said first pivot axis of said first wheel supporting bar and said second pivot axis of said second wheel supporting bar are aligned vertically with said blade drive shaft.

10. A concrete and asphalt slot cutting machine as in claim 8, wherein said first and second pivot frames are vertically adjustable with respect to said third and fourth sides of said blade platform, respectively, such that the cutting depth of said slot cutting blade is adjustable.

11. A concrete and asphalt slot cutting machine as in claim 8, and further comprising:

a) at least one pivot arm with a first end pivotably attached to the self propelled unit and a second end pivotably attached to the blade platform.

12. A concrete and asphalt slot cutting machine as in claim 11, wherein there are two of said pivot arms, each with a first end pivotably attached to aid self propelled unit, a first of said pivot arms being pivotably attached to said first side of said blade platform and a second of said pivot arms being spaced from said first pivot arm and being pivotably attached to said second side of said blade platform.

13. A concrete and asphalt slot cutting machine as in claim 12, wherein each of said pivot arms is L shaped with a long leg of each L shaped arm being pivotably attached to said self propelled unit and a short leg of each L shaped arm being pivotably attached to respective sides of said blade platform.

14. A concrete and asphalt slot cutting machine as in claim 12, and further comprising:

a) a frame extension extending outward from said self propelled unit;

b) a cross bar interconnecting said pivot arms; and c) a hydraulic piston & cylinder unit with a first end attached to said frame extension and a second end attached to said cross bar.

15. A precision concrete and asphalt slot cutting machine, comprising:

a) a self propelled unit;

b) a blade platform with first, second, third and fourth sides with said first and second sides being opposite each other and said third and fourth sides being opposite each other;

c) a slot cutting blade positioned within the blade platform;

d) a pair of pivot arms, each with a first end pivotably attached to said self propelled unit, a first of said pivot arms having a second end pivotably attached to said first side of said blade platform and a second of said pivot arms being spaced from said first pivot arm and having a second end pivotably attached to said second side of said blade platform;

e) a first wheel supporting bar with a first wheel supported near a first end thereof and a second wheel supported near a second end thereof;

f) a second wheel supporting bar with a third wheel supported near a first end thereof and a fourth wheel supported near a second end thereof;

g) a first pivot frame attached to said third side of said blade platform and pivotably supporting said first wheel supporting bar about a first pivot axis; and h) a second pivot frame attached to said fourth side of said blade platform and pivotably supporting said second wheel supporting bar about a second pivot axis.

16. A concrete and asphalt slot cutting machine as in claim 15, wherein each of said pivot arms is L shaped with a long leg of each L shaped arm being pivotably attached to said self propelled unit and a short leg of each L shaped arm being pivotably attached to said blade platform.

17. A concrete and asphalt slot cutting machine as in claim 15, and further comprising:

a) a frame extension extending outward from said self propelled unit;

b) a cross bar interconnecting said pivot arms; and c) a hydraulic piston & cylinder unit with a first end attached to said frame extension and a second end attached to said cross bar.

18. A concrete and asphalt slot cutting machine as in claim 15, and further comprising:

a) a blade drive shaft attached to said slot cutting blade;

b) drive means for driving said blade drive shaft in a rotary motion; and wherein c) said first pivot axis of said first wheel supporting bar and said second pivot axis of said second wheel supporting bar are aligned vertically with said blade drive shaft.

19. A concrete and asphalt slot cutting machine as in claim 15, wherein said first and second pivot frames are vertically adjustable with respect to said third and fourth sides of said blade platform, respectively, such that the cutting depth of said slot cutting blade is adjustable.

* * * * *